United States Patent [19]

Going, III et al.

[11] Patent Number: 4,844,166

[45] Date of Patent: Jul. 4, 1989

[54] METHOD AND APPARATUS FOR RECOMPLETING WELLS WITH COIL TUBING

[75] Inventors: Walter S. Going, III; Ronald E. Pringle, both of Houston; Arthur J. Morris, Magnolia, all of Tex.

[73] Assignee: Camco, Incorporated, Houston, Tex.

[21] Appl. No.: 205,762

[22] Filed: Jun. 13, 1988

[51] Int. Cl.[4] ..... E21B 19/22; E21B 34/10

[52] U.S. Cl. ..... 166/379; 166/77; 166/372; 166/375; 166/386

[58] Field of Search ..... 166/385, 375, 374, 386, 166/372, 384, 77, 77.5, 379, 380, 187

[56] References Cited

U.S. PATENT DOCUMENTS

| | | | |
|---|---|---|---|
| 3,373,816 | 3/1968 | Cochran | 166/386 X |
| 3,642,070 | 2/1972 | Taylor et al. | 166/374 X |
| 4,071,088 | 1/1978 | Mott | 166/375 |
| 4,319,639 | 3/1982 | Mott | 166/386 X |
| 4,478,288 | 10/1984 | Bowyer | 166/375 X |
| 4,585,061 | 4/1986 | Lyons, Jr. et al. | 166/77 |

*Primary Examiner*—Stephen J. Novosad
*Attorney, Agent, or Firm*—Fulbright & Jaworski

[57] ABSTRACT

A method and apparatus for recompleting an oil and/gas well inside of an existing well tubing in a well by supporting a coil tubing in the well tubing from a hanger assembly. A hydraulically actuated safety valve is connected in the coil tubing for controlling fluid flow through the coil tubing and is controlled by a hydraulic line connected to the safety valve and extending to the well surface outside of the coil tubing and inside of the well tubing. Packing is provided between the coil tubing and the well tubing and may include a well packer and/or annular safety valve. Gas lift mandrels may be connected to the coil tubing above the packoff.

11 Claims, 11 Drawing Sheets

Fig. 3
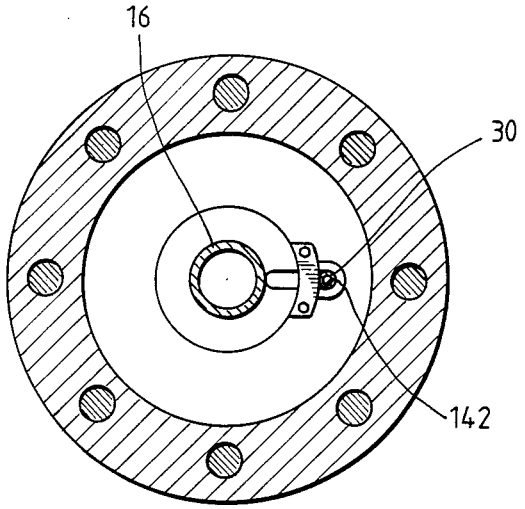
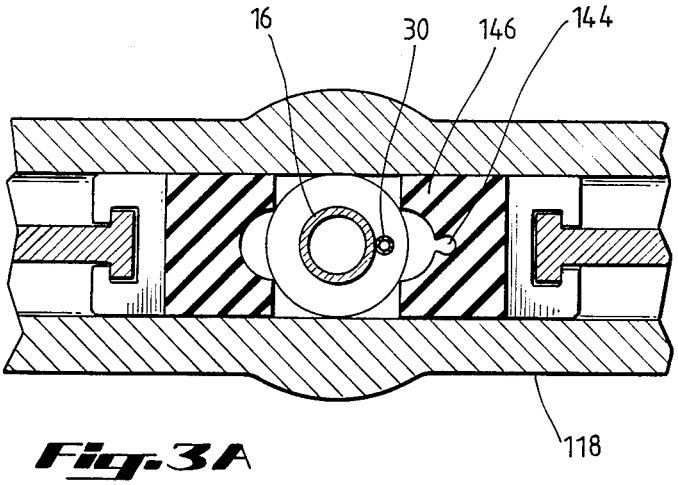
Fig. 3A

Fig. 4
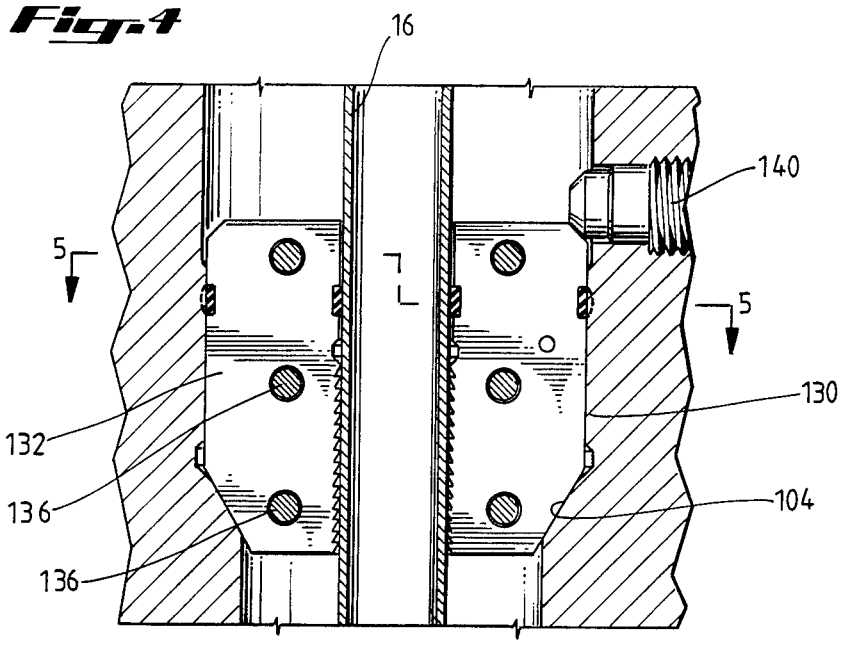
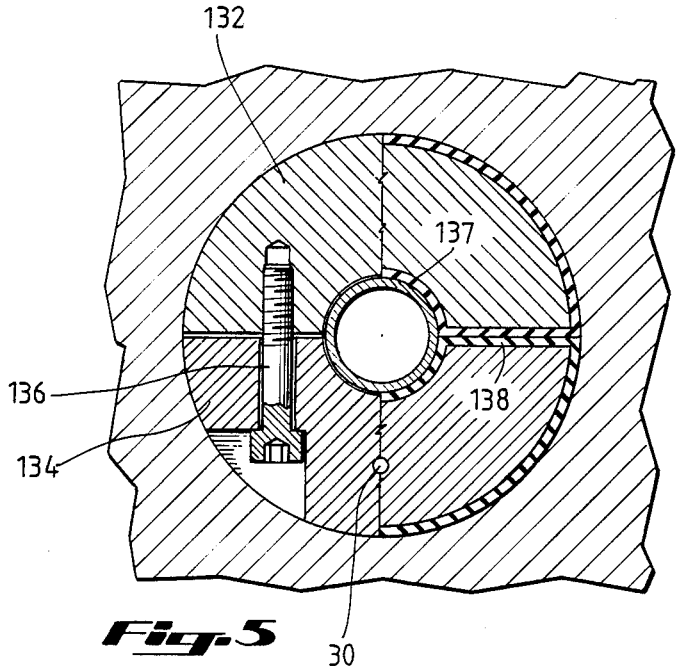
Fig. 5

METHOD AND APPARATUS FOR RECOMPLETING WELLS WITH COIL TUBING

BACKGROUND OF THE INVENTION

Oil and/or gas wells are generally produced through a conventional well tubing which include a plurality of interconnected threaded sections along with conventional production completion equipment. However, in the event that there is a failure in the production equipment, the well is killed, the entire production well tubing may be required to be removed, repaired and replaced which is an expensive and time-consuming operation requiring the use of an oil rig, and the well flow is restarted. In addition the well may be damaged.

The present invention is directed to recompleting existing oil and/or gas wells by utilizing coil tubing which along with accessories can be installed in the existing well tubing, can be utilized in a live well without killing the well, and which can provide recompletion of the well with less time and expense than conventional operations.

Coil tubing is a continuous conduit without joints carried on a reel which can be lowered into well tubing, and is of a small diameter such as 1 to 1½ inches. Coil tubing has been used in the past for injecting well fluids into well tubing, sand washing, and removal of liquids from the well, and producing wells through a free hanging length of tubing.

The present invention is directed to a method and apparatus to install a coil tubing into an existing well tubing and includes a variety of accessories such as a hydraulic control tubing safety valve, a hydraulic control annular safety valve, gas lift valves and mandrels, hydraulic control latches, and hydraulically actuated well packers along with the necessary hydraulic control lines.

SUMMARY

The present invention is directed to an apparatus for recompleting an oil well and/or gas well inside of an existing well tubing in a well and includes a hanger assembly supporting a coil tubing positioned in the well tubing, a hydraulically actuated safety valve connected in the coil tubing for controlling fluid flow through the coil tubing. A hydraulic control line is connected to the safety valve and extends to the well surface outside of the coil tubing and inside of the well tubing. Means are connected to the coil tubing for packing off the annulus between the coil tubing and the well tubing.

A further object of the present invention is wherein the packing means includes a hydraulically set packer.

Yet a still further object of the present invention is wherein the apparatus includes at least one gas lift mandrel connected to the coil tubing above the packer means.

Another object of the present invention is wherein the well tubing includes a landing nipple for a safety valve, and including a hydraulically actuated annular safety valve connected to the coil tubing and positioned in the landing nipple and connected to the hydraulic control line. Preferably the annular safety valve includes hydraulically actuated dogs for setting in the landing nipple.

Still a further object of the present invention is wherein the apparatus includes surface equipment for installing the apparatus in said well tubing and includes a coil tubing hanger bowl, a lower coil tubing slip assembly positioned above the bowl, a lower blowout preventer assembly positioned above the lower slip assembly, and a tool lubricator. In addition, a coil tubing and control line blowout preventer is positioned above the tool lubricator for sealing off both the coil tubing and the control line. A second lubricator having an openable side door is positioned above the coil tubing and control line blowout preventer for installing a coil tubing hanger. A control line stuffing box is positioned above the second lubricator for inserting the control line into the well. An upper coil tubing slip assembly is positioned above the stuffing box for supporting the coil tubing and its connected equipment as the control line is connected at a position therebelow. A coil tubing injector is positioned above the upper slip assembly for inserting the coil tubing into the well.

Still a further object of the present invention is the method of recompleting an oil and/or gas well inside an existing well tubing in a well by connecting to the well tubing sequentially in an upward direction a coil tubing hanger bowl, a lower coil tubing slip assembly, a lower blowout preventer assembly, a tool lubricator, and a coil tubing injector. Thereafter, the coil tubing is run through the lubricator, the lubricator is disconnected and a well packer is connected to the coil tubing. The lubricator is reconnected and the well packer is lowered into the well tubing by the coil tubing and the lower slip assembly and the blowout preventer is closed on the coil tubing for shutting in the well. The lubricator is then disconnected and one or more gas lift mandrels are spliced into the coil tubing. The lubricator is reconnected, the slip assembly and blowout preventer is retracted, and the coil tubing is lowered with the mandrel and packer into the well tubing and the slip assembly and blowout preventer is again closed on the coil tubing. The lubricator is again disconnected and additional service equipment is added above the lubricator sequentially in an upwardly direction, of a coil tubing and control line blowout preventer, a second lubricator having an openable side door, a control line stuffing box, and an upper coil tube slip assembly. A hydraulic controlled safety valve is spliced into the coil tubing and the control line is extended through the stuffing box and connected to the safety valve. The tubing lubricator is again reconnected and the safety valve is lowered into the well tubing and the upper coil tubing slip assembly and the coil tubing and control line blowout preventer is closed so that the side door of the second lubricator may be opened. A coil tubing hanger assembly is connected through the side door to the coil tubing and the control line. Thereafter, the side door is closed, the coil tubing and control line blowout preventer and upper slip assembly is opened and the coil tubing hanger is lowered onto the bowl.

Other and further objects, features, and advantages will be apparent from the following description of a presently preferred embodiment of the invention, given for the purpose of disclosure and taken in conjunction with the accompanying drawings.

BRIEF DESCRIPTION OF THE DRAWINGS

FIG. 3 is a cross-sectional view, taken along the line 3—3 of FIG. 1D, FIG. 3A is a cross-sectional view, taken along line 3A—3A of FIG. 1D, FIG. 4 is a fragmentary elevational view, in cross section, of the coil tubing hanger of the present invention, and FIG. 5 is a cross-sectional view, taken along the line 5—5 of FIG. 4.

DESCRIPTION OF THE PREFERRED EMBODIMENTS

Figures 1A, 1B:
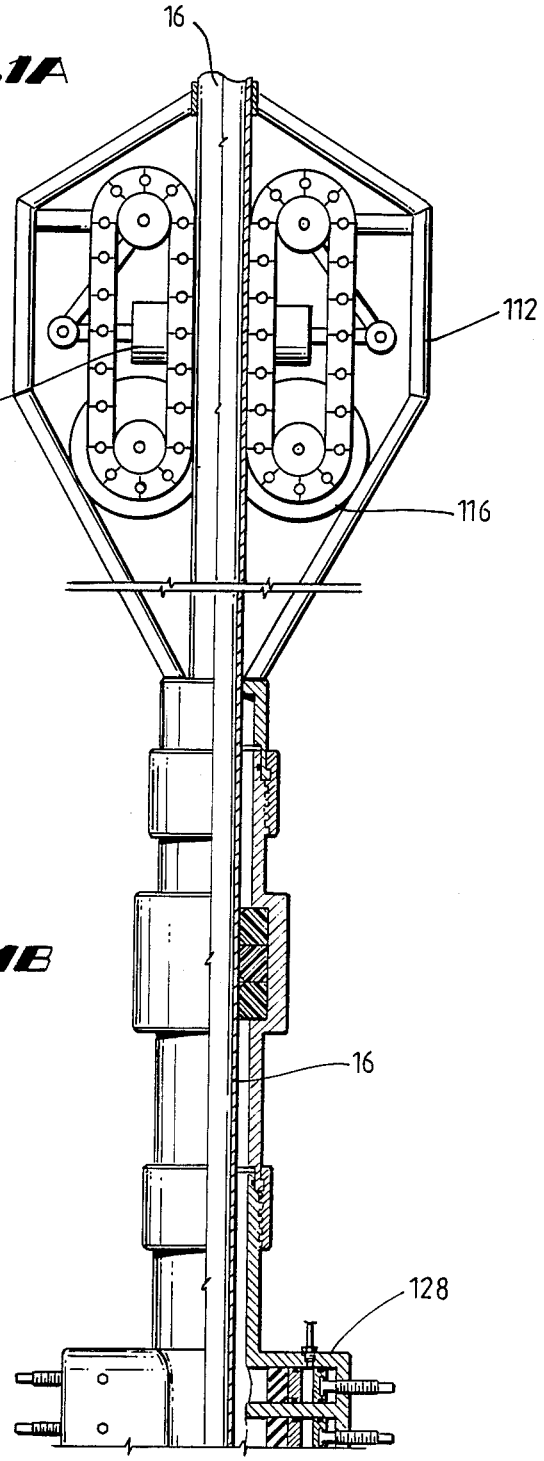
FIG. 1A, 1B, 1C, 1D, 1E, 1F, and 1G are continuations of each other and are an elevational view, partly in section, of the above ground portion of the service equipment used for installing the well installation.
Figures 1C, 1D:
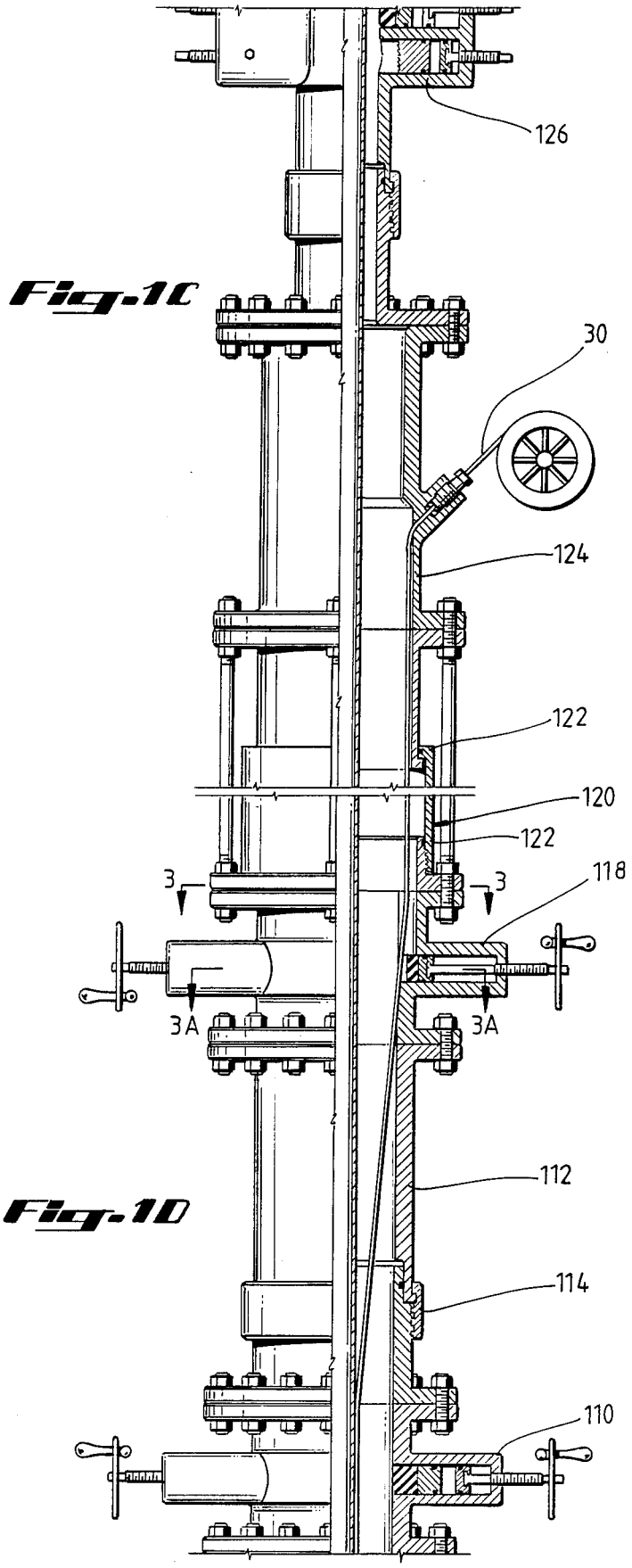

Referring now to the drawings, and particularly to FIGS. 2A–2K, the reference numeral 10 generally indicates the apparatus of the present invention which generally includes the well casing 12, the existing well tubing 14, and the coil tubing 16 of the present invention. Originally, oil and/or gas was produced from the well through the production tubing 14 which generally consists of a plurality of rigid threaded sections of pipe. In the event that there was a failure in the original production equipment, it will be a normal practice to kill the well, remove the well tubing 14, and its associated equipment, repair or replace the defective equipment, and restart the well. This procedure is expensive, time-consuming, and may result in damage to the well.

The present invention is directed to recompleting the well with coil tubing and a variety of coil tubing accessories which are inserted within the inside of the existing well tubing 14 without the necessity of killing the well. Therefore, the present method and apparatus provides an easier, less time-consuming, and cheaper method of recompleting the well without the necessity of killing the well. The coil tubing installation of the present invention may use a variety of accessories connected to the coil tubing 16 such as a hydraulic controlled tubing safety valve 18 (FIGS. 2A and 2B), a hydraulic controlled annular safety valve generally indicated by the reference numeral 20 (FIGS. 2B, 2C and 2D), one or more gas lift mandrels 22 (FIG. 2F), a hydraulic set, straight pull release, well packer generally indicated by the reference numeral 24 (FIGS. 2H, 2I and 2J), and a pump-out plug, generally indicated by the reference numeral 26 (FIG. 2K). The tubing safety valve 18, the annular safety valve 20, the gas lift mandrel 22, the well packer 24 may be spliced into and connected to the coil tubing 16 by suitable coil tubing crossover pin thread connectors 28.

Figure 2A:
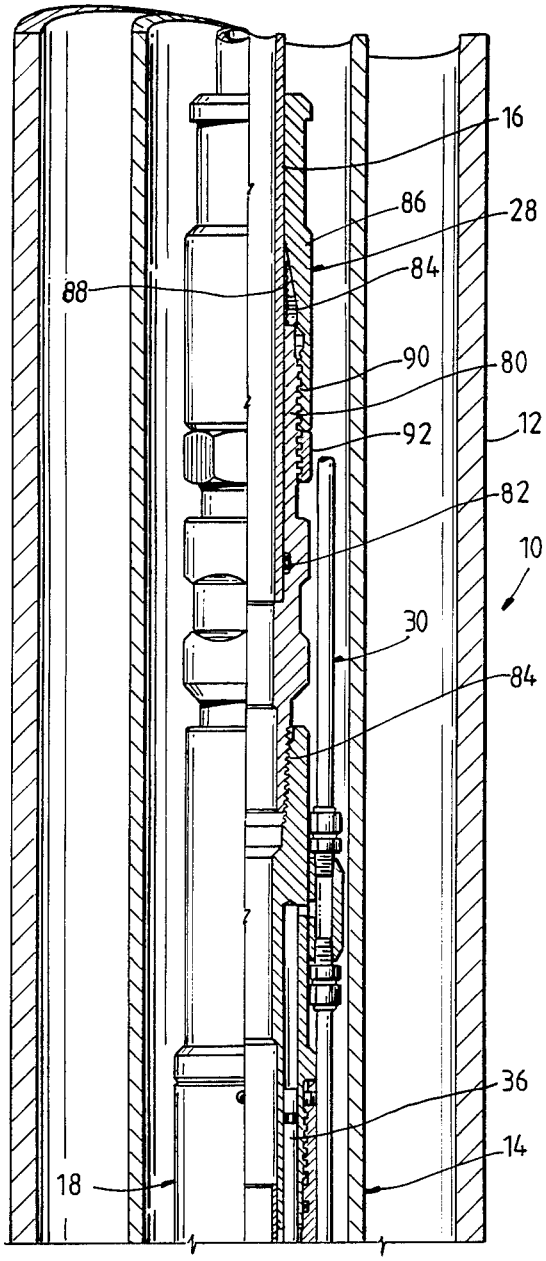
FIG. 2A, 2B, 2C, 2D, 2E, 2F, 2G, 2H, 2I, 2J and 2K are continuations of each other and form an elevational view, partly in section, illustrating one form of the well installation of the present invention.
Figure 2B:
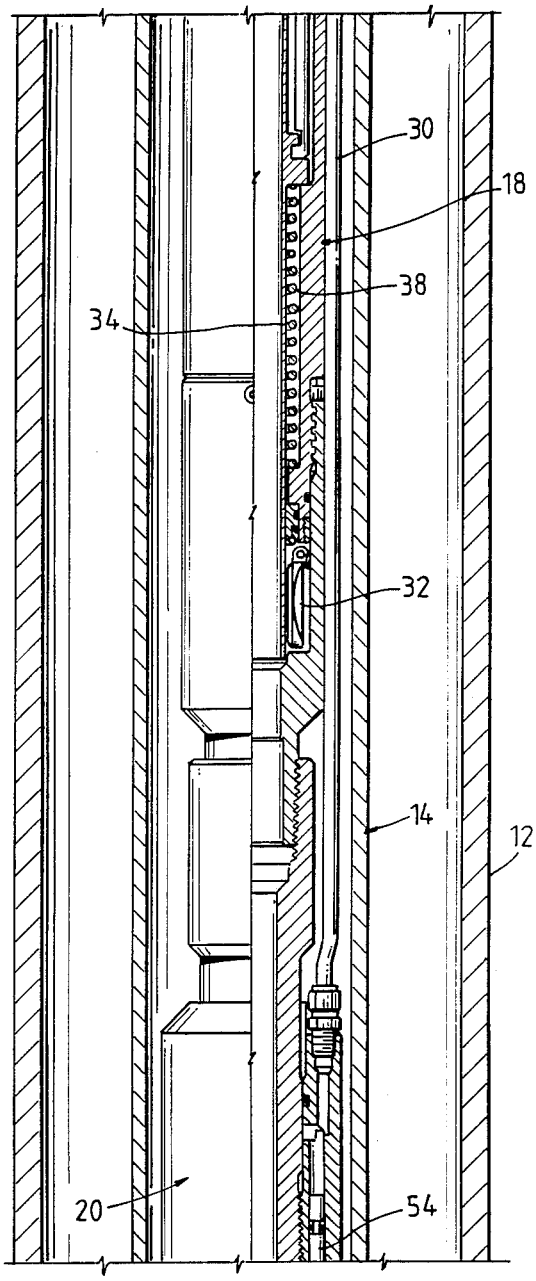

Referring now to FIGS. 2A and 2B, the hydraulically controlled tubing safety valve 18 may be of any suitable type such as a Camco type TRSP safety valve which is controlled by a hydraulic control line 30 connected to the safety valve 18 and extends to the well surface out side of the coil tubing 16 and inside of the existing well tubing 14. The safety valve 18 controls fluid flow through the coil tubing 16. The safety valve 18 includes a valve closure member 32 which is controlled by the movement of a flow tube 34 which is moved to the open position by a piston and cylinder assembly 36 in communication with the hydraulic control line 30 and is biased to the closed position by suitable biasing means such as a spring 38 and well fluid acting on the underside of the piston and cylinder assembly 36.

Figure 2C:
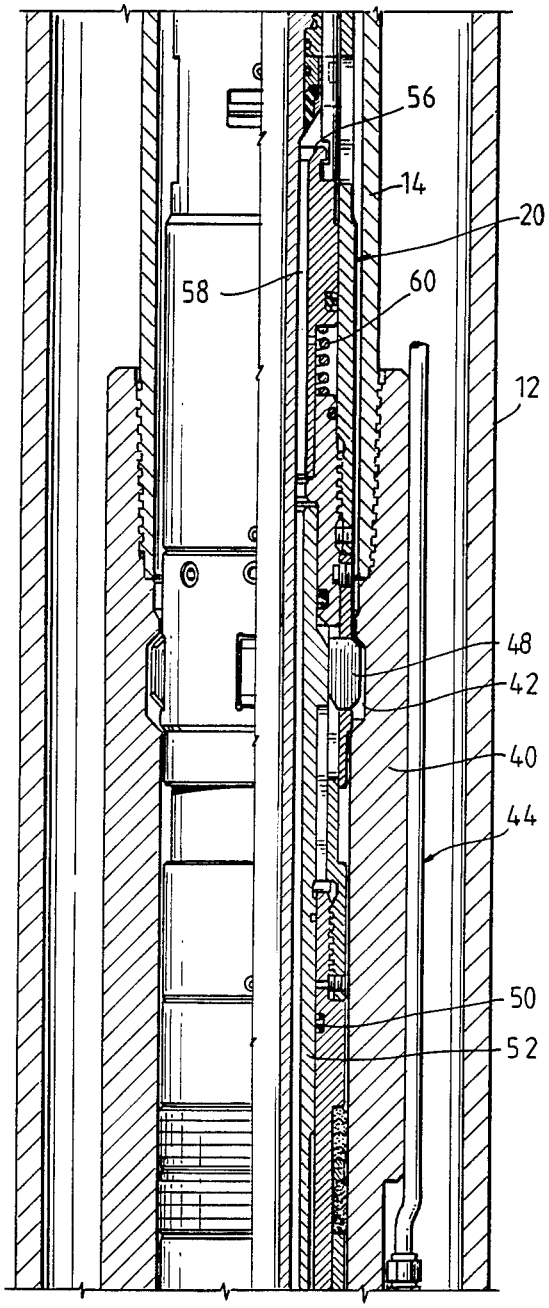
Figure 2D:
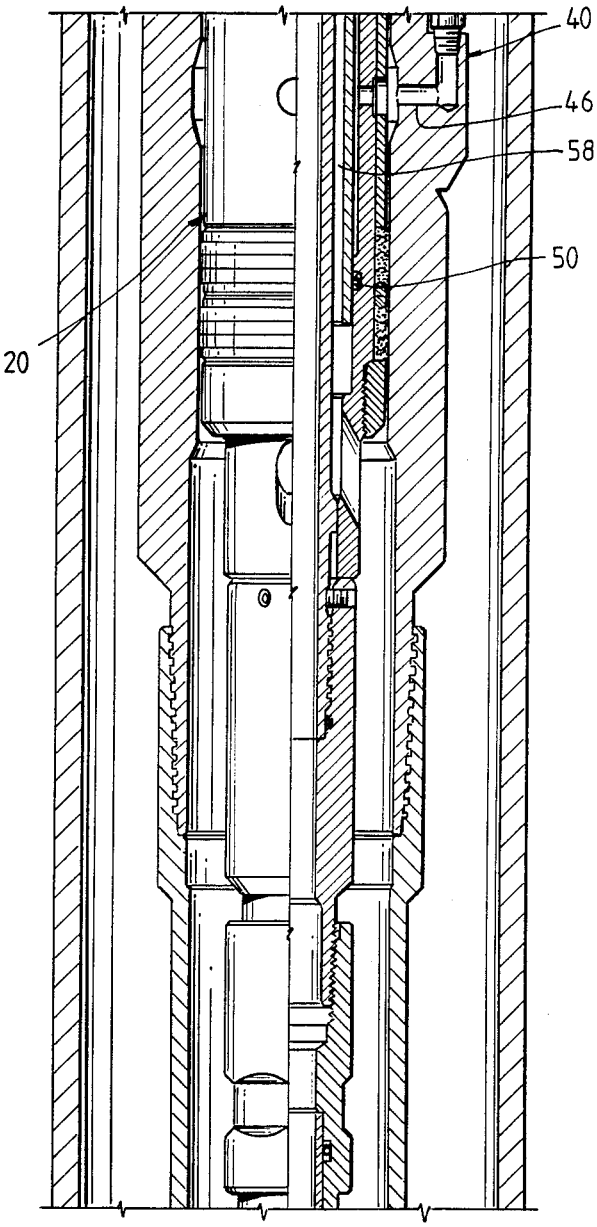
Figure 2E:
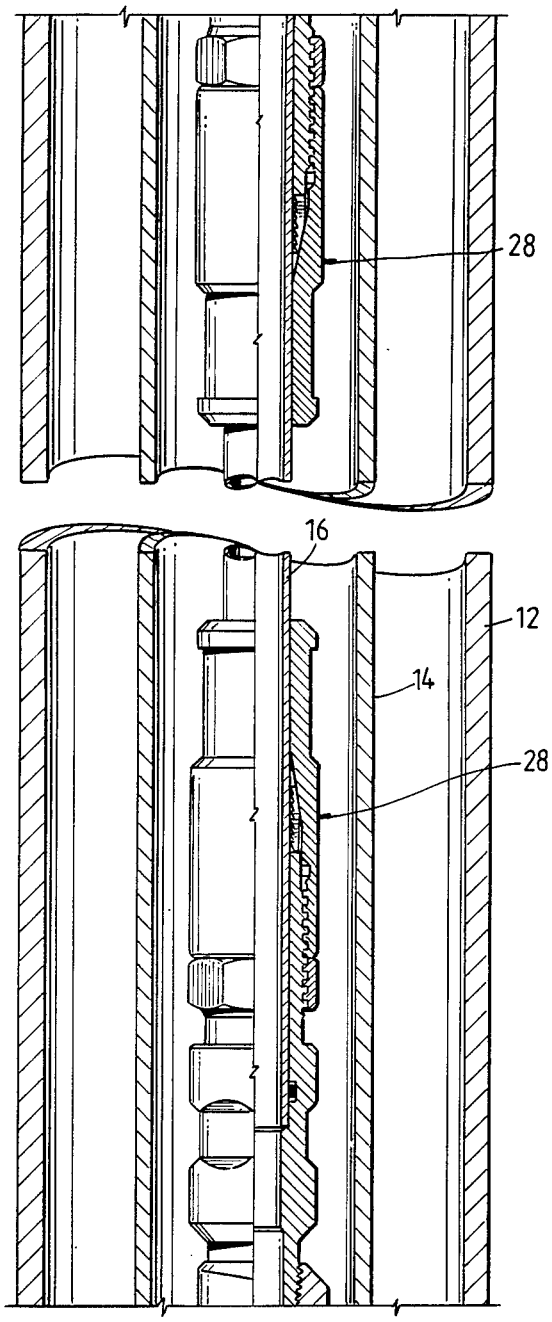

Referring now to FIGS. 2B, 2C, and 2D, the hydraulically controlled annular safety valve 20 may be of an suitable type such as a Camco Model TRAC which is hydraulically set with a straight pull release holddown. The safety valve 20 may be set in the existing landing nipple 40 in the existing well tubing 14 which was previously used for wireline retrieval tubing safety valve and includes a locking notch 42 and a hydraulic control line 44 having a hydraulic control port 46. The safety valve 20 includes locking dogs 48 which are set into the locking notch 42 by hydraulic fluid from the control line 44 in which the fluid flowing through port 46 acts across seals 50 in a piston 52 for hydraulically locking the dogs 48 in the notch 42. The hydraulic control line 30 extends from the tubing safety valve 18 to the annular safety valve 20 to actuate a piston and cylinder assembly 54 for moving a valve 56 to the open position for opening a passageway 58 which extends between the annulus between the well casing 12 and the well tubing 14 from below to above the safety valve 20. However, if desired, safety valve 20 may be controlled by a separate hydraulic control line. Biasing means 60 moves the valve 56 to the closed position.

Therefore, the annular safety valve 20 packs off across the port 46, also opens and closes fluid communication in the annulus between the casing 12 and the tubing 14, and acts to secure the coil tubing 16 to the well tubing 14.

Figure 2F:
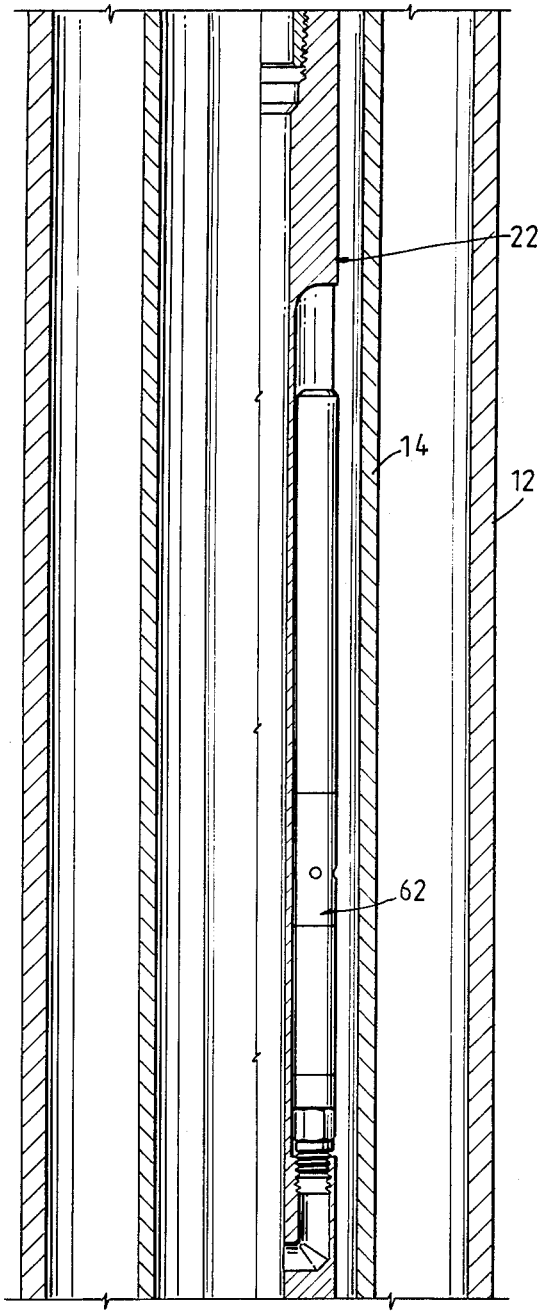
Figure 2G:
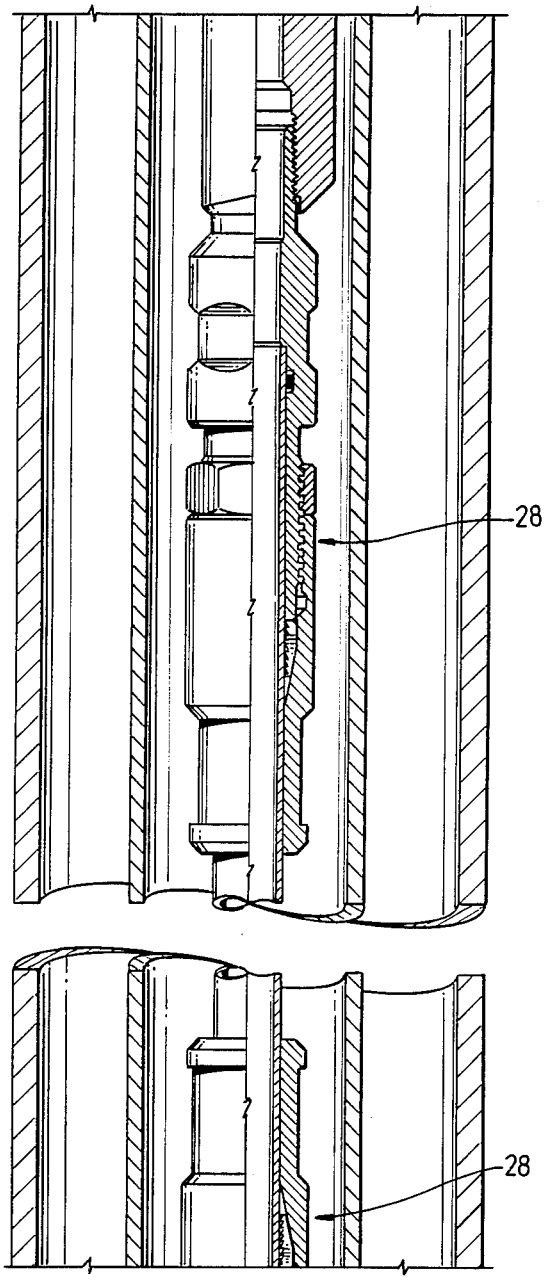

Referring now to FIG. 2F, one or more suitable gas lift mandrels, here shown as one for convenience, such as a Camco J-50 gas lift mandrel may be provided having a conventional J-50 gas lift valve 62 for conventionally supplying gas from the annulus between the casing 12 and the existing well tubing 14 into the bore of the mandrel 42 to assist in lifting liquids from the well.

Figure 2H:
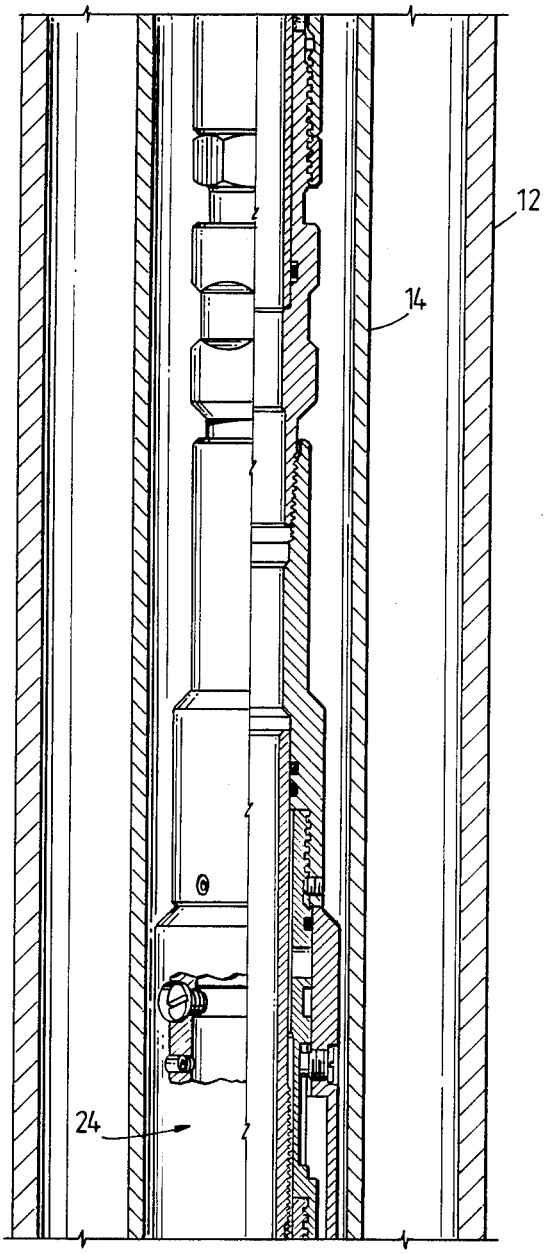
Figure 2I:
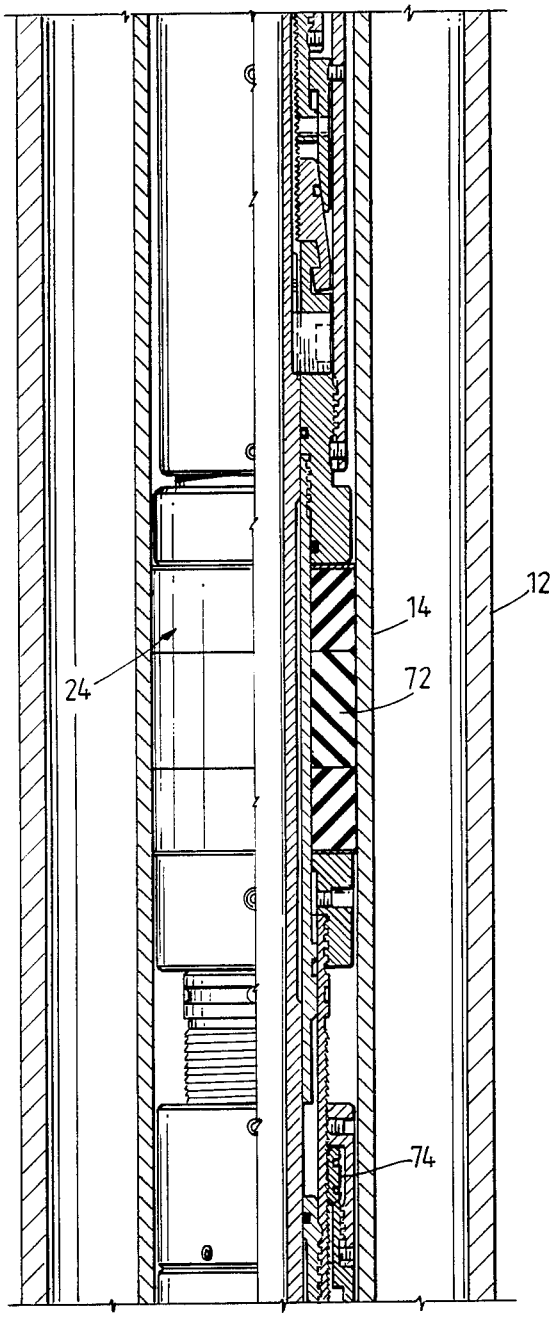
Figure 2J:
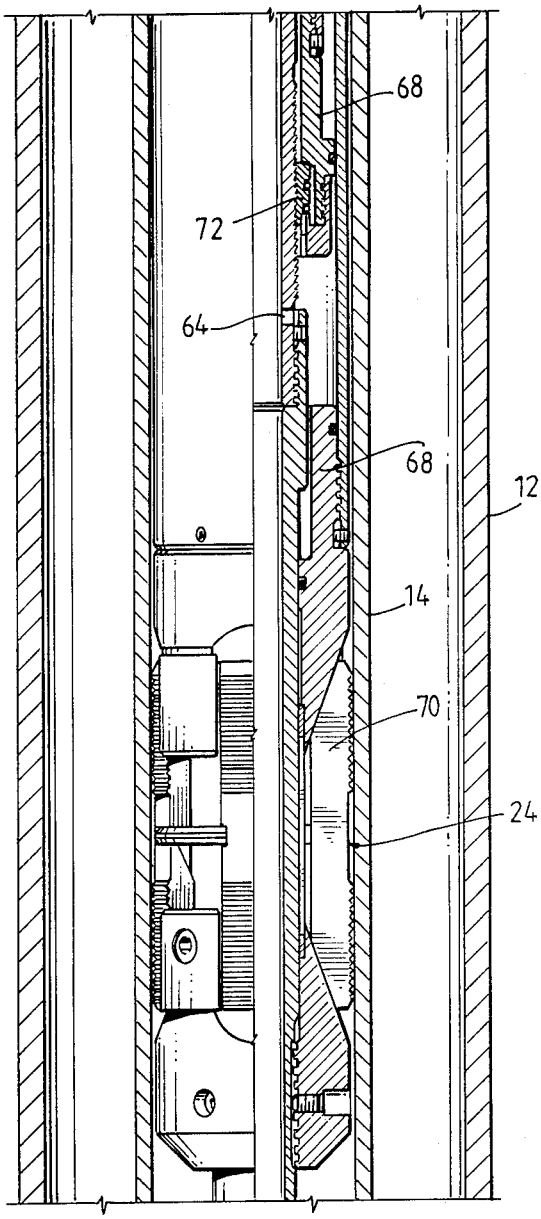
Figure 2K:
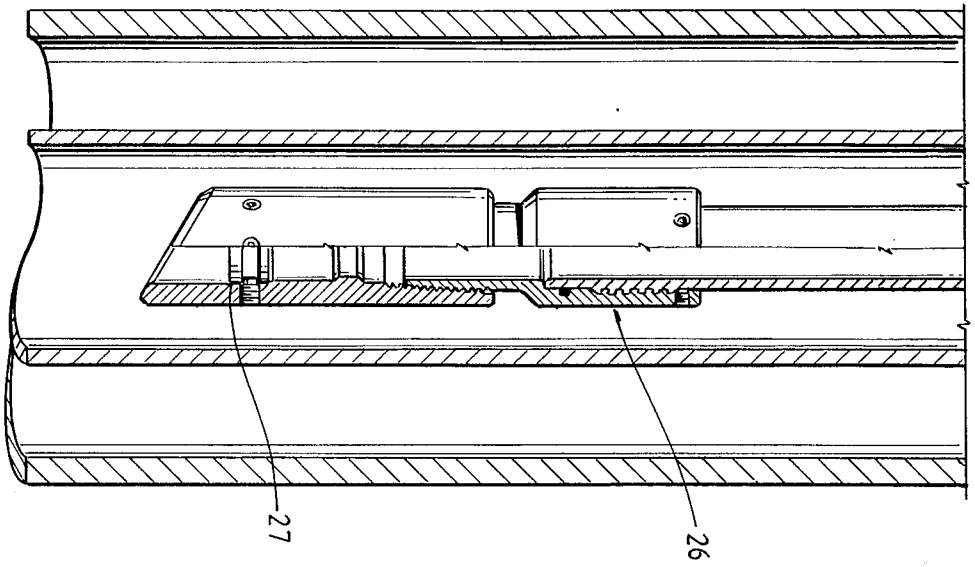

Referring now to FIGS. 2H, 2I and 2J, a conventional hydraulically set straight pull release well packer 24 is shown in position sealing off the annulus between the existing production well tubing 14 and the coil tubing 16. Any suitable packer such as a Camco Type HRP-SP packer may be used. Generally, the packer includes a hydraulic port 64 for admitting hydraulic fluid from the bore to act against pistons 66 and 68 for setting the slips 70 and the packer element 72, respectively. Ratchets 74 and 76 hold the slips 70 and packer element 72 in the set position. The packer is set by pressuring up the packer 24 to its set position, and thereafter expelling a plug element 2T (FIG. 2K) from the pump-out plug 26 for production through the coil tubing 16. In some installations, only one of the annular control valve 20 or packer 24 may be necessary and in some instances if the well does not need gas lift assistance, the gas lift mandrels 22 may be omitted.

The various connectors 28 may be provided for connecting the various accessories through the coil tubing 16. A connector 28, as best seen in FIG. 2A, includes a body 80 for receiving the coil tubing 16 and seals thereagainst by a seal 82. The body 80 includes a threaded connection 84 for threadably attachment to another accessory such as the safety valve 18. The connector 28 includes a plurality of slips 84 for gripping the exterior of the coil tubing 16. A gripping relationship by a member 86 having a tapered surface 88 is used for wedging the slips 84 inwardly by a threaded connection 90 with the body 80. Lock nut 92 locks the member 86 to the body 80.

In any event, the installation shown in FIGS. 2A–2K may be connected to a coil tubing and installed in the existing well production tubing 14 after removing any wire line retrievable tubing safety valve from the landing nipple 40. The coil tubing installation of the present invention may be installed without killing the well and provides a miniature recompletion system which provides all of the accessories necessary to produce the well through the coil tubing as well as to provide the necessary safety equipment for protecting the well.

Referring now to FIG. 1A, 1B, 1C, 1D, 1E, 1F, 1G, 3, 4 and 5, the service installation for installing the coil tubing and accessories of FIGS. 2A–2J is best seen.

Figures 1E, 1F, 1G:
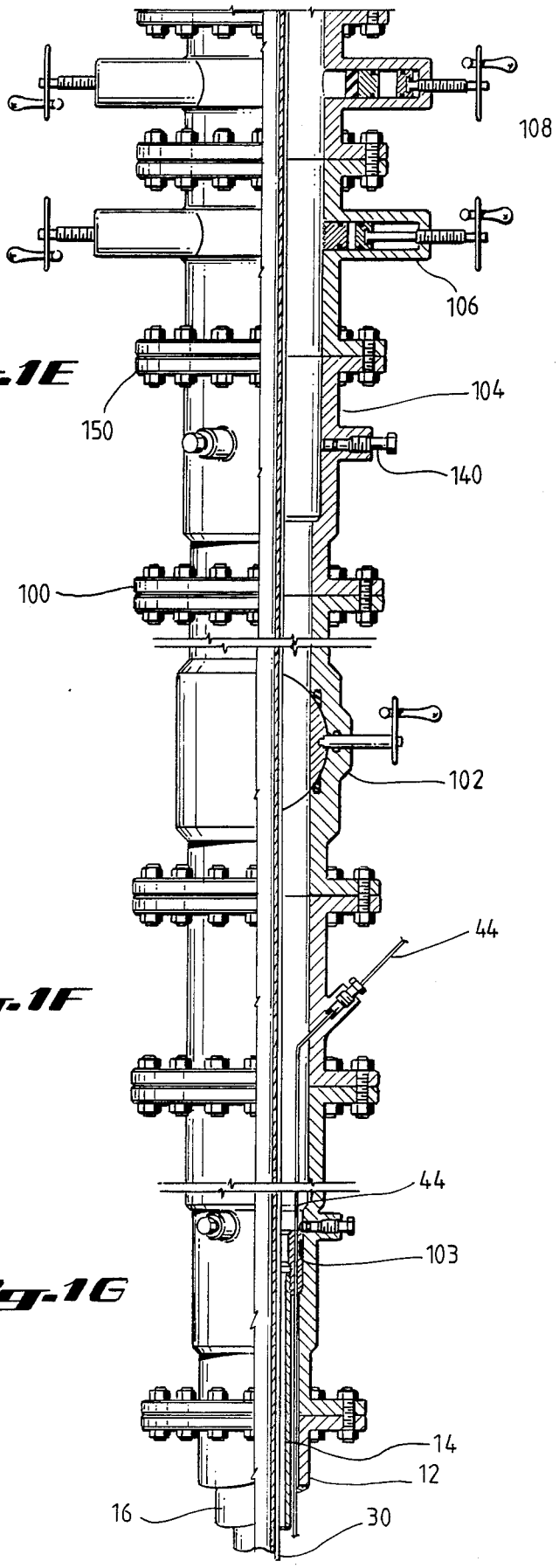

Referring now to FIGS. 1E, 1F and 1G, the existing wellhead which is retained is shown which includes the flange 100, the master valve 102, the hydraulic control line 44 for the original production tubing safety valve, and the tubing hanger 103 as well as the casing 12, existing production tubing 14 and the newly-added coil tubing 16 and control line 30. The remainder of the original production tree above the flange 100 is removed for installing service tools and equipment for installing the coil tubing installation in a live well.

To the flange 100 a coil tubing hanger bowl 104 is installed along with a lower coil tubing slip assembly 106 and a lower blowout preventer assembly which may include a coil tubing ram blowout preventer 108 and a blind ram blowout preventer 110 (FIG. 1D) along with a tool lubricator 112 having a quick connect and disconnect union 114. While the remainder of the equipment, which will be more fully described hereinafter, may be installed at this time, it is more convenient at this time to only install the coil tube injector 112 (FIG. 1A) which receives the coil tubing 16 from a conventional reel and by the use of hydraulic cylinders 114 and motor 116 conventionally pulls the coil tubing 16 off of a reel and injects it into a well.

Initially, the master valve 102 is closed, the lubricator 112 is disconnected by the union 114 and the lower end of the coil tubing 16 is rigged through a disconnected tool lubricator 112 and the bottom hole tools such as the pumpout plug 26 and well packer 24 are connected to the coil tubing 16. The plug 26 includes a releasable plug element 27 which initially prevents entry of well fluids into the coil tubing 16 during the recompletion operation. The packer 24 and plug 26 are retracted into the lubricator 112, the lubricator is then reattached, the master valve 102 is opened, and a portion of the coil tubing 16 including the packer 24 and plug 26 is lowered into the existing well tubing 14. The coil tubing ram blowout preventer 108 and lower coil tubing slip assembly 106 is closed thereby closing off any well fluids and supporting the coil tubing 16 and packer 24 and plug 26. The lubricator 112 is then disconnected and the coil tubing 16 is cut at the proper location for inserting a gas lift mandrel 22 which is spliced into the coil tubing 28 by connectors 28. The lubricator 112 is then reconnected, the blowout preventer 110 and slips 108 are retracted. Additional gas lift mandrels 22 may be similarly spliced into the coil tubing 16.

The coil tubing now with the gas lift mandrels 22, well packer 24 and plug 26 are lowered further into the well tubing 14 and again the blowout preventer 108 and slips 106 are set.

The lubricator 112 is again disconnected and additional equipment is attached thereto including a coil tubing and control line ram blowout preventer 118 (Fig. 1D), a second lubricator 120 having an openable door 122 (FIG. 1C and 1D), and a control line stuffing box 124, an upper coil tubing slip assembly 126 and upper coil tubing blowout preventer 128.

The hydraulic control line 30 is fed through the stuffing box 124 and the lubricator 112 and into a groove, which will be more fully described hereinafter, of the coil tubing and control line blowout preventer 118 and through the lubricator 112. With the lubricator 112 disconnected, the safety valves 18 and 20 is connected in the coil tubing line 16 and the hydraulic control line 30 attached to the valves 18 and 20. Again the lubricator 112 is reconnected, the lower blowout preventer 110 and slips 108 are released and the coil tubing 16 is run further into the well tubing 14 with the annular safety valves 18 and 20.

At this time the control line 30 is extending into the well outside of the coil tubing 16 and inside of the well tubing 14. Therefore, in order to support the coil tubing and protect the live well, the upper coil tubing slip assembly 126 is actuated to support the coil tubing 16 and the coil tubing and control line blowout preventer 110 is actuated to seal off around the control line 30 and the coil tubing 16. The openable door 122 on the second lubricator 120 is opened and the control line 30 is cut and fished out of the open door 122.

As best seen in FIGS. 4 and 5, a coil tubing hanger generally indicated by the reference numeral 130 is a split hanger having parts 132 and 134 and seals 137 and 138 is inserted through the open side door 122 and connected about the coil tubing 16 by bolts 136. The control line 30 is cut to the desired length and connected to the underside of the hanger 130. The side door 122 is closed, blowout preventer 118 and slips 126 are retracted and the coil tubing 16 is lowered to align the dogs 48 of the annular packer 20 with the notch 42 in the landing nipple 40 and are hydraulically latched therein, and simultaneously the hanger 130 is landed in the hanger bowl 104. The hanger retaining pins 140 are tightened to secure the hanger in place.

Referring now to FIGS. 3 and 3A, a groove 142 is provided above the control line and coil tubing blowing preventer 110 for receiving the control line 30 for aligning it with a notch 144 in the packing 146 of the blowout preventer 110 for allowing packoff and sealing by the preventer 110 around both the control line 30 and coil tubing 16 without crushing the control line 30.

After the hanger 130 is seated in its bowl 104, hyraulic pressure is applied to the packer 24 through the bore of coil tubing 16 for setting the packer 24 and thereafter expelling plug element 27. The safety valves 18 and 20 may be closed and all of the service equipment above the flange 150 may be removed and conventional production equipment and hydraulic control line connections and flowline connections may be made.

The method of recompleting and oil and/or gas well inside of an existing well tubing in a well is apparent from the foregoing description of the installation and operation of the apparatus 10. The method includes connecting to the well tubing sequentially in an upward direction, a coil tubing hanger bowl, a lower coil tubing slip assembly, a lower blowout preventer assembly, a tool lubricator, and a coil tubing injector. Thereafter, the coil tubing is run through the lubricator which is disconnected and a well packer is connected to the coil tubing. The lubricator is reconnected and the well packer is lowered into the well tubing by the coil tubing. The slip assembly and the blowout assembly is closed on the tubing coil and the lubricator is again disconnected and a gas lift mandrel is spliced into the coil tubing. The lubricator is reconnected, the slip assembly and blowout preventer assembly is retracted, and the coil tubing with the mandrel and packer is lowered further into the well tubing and again the slip assembly and blowout preventer is closed. Additional gas lift valves may be similarly installed. Thereafter the lubricator is disconnected and a coil tubing and control line blowout preventer, a second lubricator having an openable side door, a control line stuffing box and an upper coil tubing slip assembly is attached. A hydraulic controlled tubing safety valve is connected into the coil tubing and a control line is extended from the stuffing box and connected to the safety valve. After again reconnecting the tool lubricator, the tubing safety valve is lowered into the well tubing by the coil tubing. The coil tubing and control line blowout preventer and upper coil tubing slip assembly is closed and the side door of the second lubricator is opened through which a coil tubing hanger assembly is connected to the coil tubing and the control line. The side door is closed and the coil tubing and control line blowout preventer and upper coil tubing assembly is opened and the tubing hanger is lowered and landed on the bowl.

The present invention, therefore, is well adapted to carry out the objects and attain the ends and advantages mentioned as well as others inherent therein. While a presently preferred embodiment of the invention has been given for the purpose of disclosure, numerous changes in the details of construction, and steps of the methods, will be readily apparent to those skilled in the art and which are encompassed with the spirit of the invention and the scope of the appended claims.

What is claimed is:

1. An apparatus for recompleting an oil and/or gas well inside an existing well tubing in a well comprising, a hanger assembly supporting a coil tubing positioned in the well tubing, a hydraulically actuated safety valve connected in the coil tubing for controlling fluid flow through the coil tubing, a hydraulic control line connected to the safety valve and extending to the well surface outside of the coil tubing and inside of the wall tubing, and means connected to the coil tubing for packing off the annulus between the coil tubing and the well tubing.

2. The apparatus of claim 1 wherein the packing means includes a hydraulically set packer.

3. The apparatus of claim 2 including, at least one gas lift mandrel connected to the coil tubing above the packer.

4. The apparatus of claim 1 wherein the well tubing includes a landing nipple for a safety valve having a hydraulic inlet port and said packing means includes means for packing off across the port.

5. The apparatus of claim 1 wherein the well tubing includes a landing nipple for a safety valve, and including a hydraulically actuated annular safety valve connected to the coil tubing and positioned in the landing nipple and connected to the hydraulic control line.

6. The apparatus of claim 5 wherein the annular safety valve includes hydraulically actuated dogs for setting in the landing nipple.

7. An apparatus for recompleting an oil and/or gas well inside an existing well production tubing in a well comprising, a hanger assembly supporting a coil tubing in the well tubing, a hydraulically actuated safety valve connected in the coil tubing for controlling fluid flow through the coil tubing, a hydraulic control line connected to the safety valve and extending to the well surface outside of the coil tubing and inside of the wall tubing, at least one gas lift mandrel connected to the coil tubing for admitting gas from between the coil tubing and the well tubing into the coil tubing, a hydraulically actuated straight pull release well packer connected to the coil tubing for sealing off between the outside of the coil tubing and the inside of the well tubing.

8. The apparatus of claim 7 wherein the well tubing includes a landing nipple with a hydraulic control port and including, an annular well safety valve connected to the coil tubing, positioned in the landing nipple, and controlled from the hydraulic control line.

9. The apparatus of claim 1 wherein the annular safety valve includes hydraulic actuated dogs for setting in the landing nipple by fluid from the hydraulic port.

10. The apparatus of claim 1 including surface equipment for installing said apparatus in said well tubing comprising, a coil tubing hanger bowl, a lower coil tubing slip assembly positioned above the bowl, a lower blowout preventer assembly positioned above the lower slip assembly, a tool lubricator positioned above the lower blowout preventer assembly, a coil tubing and control line blowout preventer positioned above the tool lubricator, a second lubricator having an openable side door positioned above the coil tubing and control line blowout preventer, a control line stuffing box positioned above the second lubricator, an upper coil tubing slip assembly positioned above the stuffing box, and a coil tubing injector positioned above the upper slip assembly.

11. The method of recompleting an oil and/or gas well inside an existing well tubing in a well comprising, connecting to the well tubing sequentially in an upward direction a coil tubing hanger bowl, a lower coil tubing slip assembly, a lower blowout preventer assembly, a tool lubricator, and a coil tubing injector, run the coil tubing through the lubricator, disconnect the lubricator and attach a well packer to the coil tubing, reconnect the lubricator and lower the attached well packer into the well tubing by the coil tubing, close the slip assembly and blowout preventer assembly on the coil tubing, disconnect the lubricator and splice a gas lift mandrel into the coil tubing, reconnect the lubricator, retract the slip assembly and blowout preventer assembly, lower the coil tubing with the mandrel and packer into the well tubing, and again close the slip assembly and blowout preventer on the coil tubing, disconnect the lubricator and add above the lubricator sequentially in an upward direction a coil tubing and control line blowout preventer, a second lubricator having an openable side door, a control line stuffing box, and an upper coil tubing slip assembly, splice a hydraulically controlled safety valve into the coil tubing, extend a control line through the stuffing box and connect the line to the safety valve, reconnect the tool lubricator and lower the safety valve into the well tubing by the coil tubing, close the coil tubing and control line blowout preventer and the upper coil tubing slip assembly, open the side door of the second lubricator and connect a coil tubing hanger assembly to the coil tubing and the control line, close the side door, open the coil tubing and control line blowout preventer and the upper coil tubing slip assembly, and lower the coil tubing hanger onto the bowl.

* * * * *

UNITED STATES PATENT OFFICE

CERTIFICATE OF CORRECTION

Patent No. 4,844,166 Dated July 4, 1989

Inventor(s) Walter S. Going III et al.

It is certified that error appears in the above-identified patent and that said Letters Patent is hereby corrected as shown below:

Column 6, line 50, delete the first occurrence of "and" and insert therefor -- an --

Column 7, line 27, delete "with" and insert therefor -- within --

Column 8, line 3, delete "wall" and insert therefor -- well --

Signed and Sealed this

Fifteenth Day of May, 1990

*Attest:*

HARRY F. MANBECK, JR.

*Attesting Officer*

*Commissioner of Patents and Trademarks*